US005820017A

United States Patent [19]

Eliovson et al.

[11] Patent Number: 5,820,017

[45] Date of Patent: Oct. 13, 1998

[54] FLUID CONTAINERS AND METHODS OF MANUFACTURE THEREOF

[75] Inventors: Robin David Eliovson, Sandton; Thomas Edward Horan, Roodepoort; John Christopher Dower, Craighall, all of South Africa

[73] Assignee: Legend Incorporation Limited, Vaduz, Liechtenstein

[21] Appl. No.: 680,025

[22] Filed: Jul. 15, 1996

[30] Foreign Application Priority Data

Nov. 16, 1994 [ZA] South Africa ..... 94/9092
Sep. 14, 1995 [ZA] South Africa ..... 95/7731

[51] Int. Cl.[6] ..... B65D 5/54

[52] U.S. Cl. ..... 229/217; 229/204; 229/219

[58] Field of Search ..... 229/204, 215, 229/216, 217; 220/462

[56] References Cited

U.S. PATENT DOCUMENTS

| | | | |
|---|---|---|---|
| 2,151,202 | 3/1939 | Guyer . | |
| 2,982,461 | 5/1961 | Hultin | 229/215 |
| 3,339,820 | 9/1967 | Kryzanowski | 229/216 |
| 3,795,359 | 3/1974 | Rausing | 229/216 |
| 4,245,743 | 1/1981 | Heuberger . | |
| 4,546,884 | 10/1985 | Kuchenbecker . | |
| 4,915,236 | 4/1990 | Kamin et al. | 229/216 |

FOREIGN PATENT DOCUMENTS

| | | | |
|---|---|---|---|
| 27 17 38 | 7/1965 | Australia . | |
| 34526/95 | 5/1996 | Australia . | |
| 2552403 | 3/1985 | France . | |
| 2680763 | 3/1993 | France . | |
| 2208891 | 8/1973 | Germany | 229/215 |

*Primary Examiner*—Gary E. Elkins
*Attorney, Agent, or Firm*—Jacobson, Price, Holman & Stern, PLLC

[57] ABSTRACT

A bag-in-the-box container comprises a box folded from flexible sheet material and having side walls, a bottom closure and a top closure. An integral pouring spout formation is formed between one of the side walls and the top closure. The pouring spout formation comprises a lower projecting wall which folds along a lower fold line with respect to the side wall and an upper wall arrangement including a rear portion which forms part of the top closure and a front projecting wing portion which is delineated from the rear portion by means of at least one upper fold line. The upper wall is preformed to bow upwardly above the plane of the top closure and the lower projecting wall so as to define a spout passage in conjunction with the lower projecting wall when the pouring spout formation is in the raised pouring position and to collapse towards the lower projecting wall when the pouring spout is folded downwardly into a lowered position against the side wall. A fluid-tight bag is arranged to fit into the box, the bag having an inner spout which is located within the spout passage. The tip of the inner spout nests within the tip of the pouring spout formation, so that both tips can simultaneously be snipped or torn off in a single cutting or tearing operation to obtain access to the fluid within the bag. The invention extends to a method of forming a bag-in-the-box container.

13 Claims, 7 Drawing Sheets

Fig 1
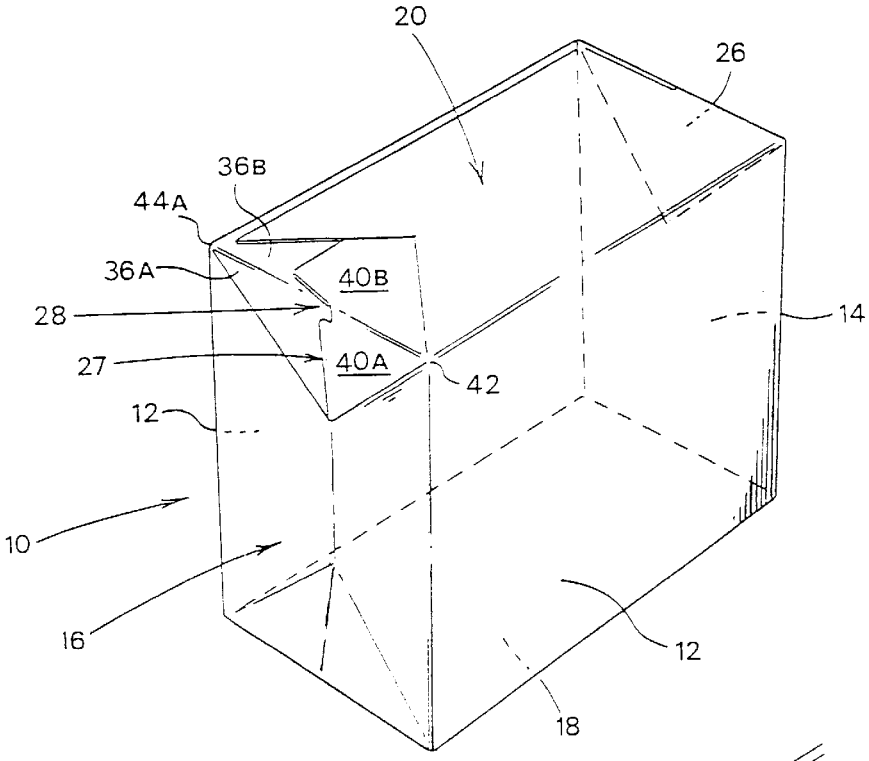
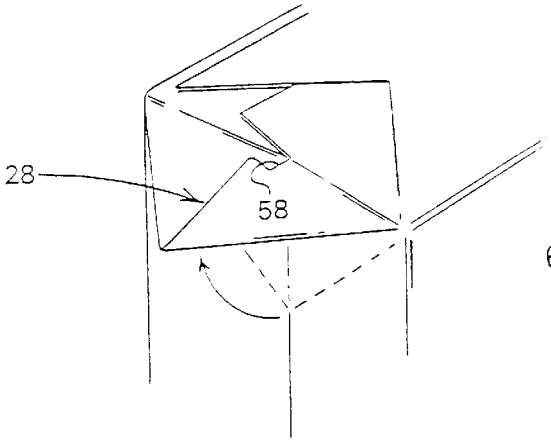
Fig 2
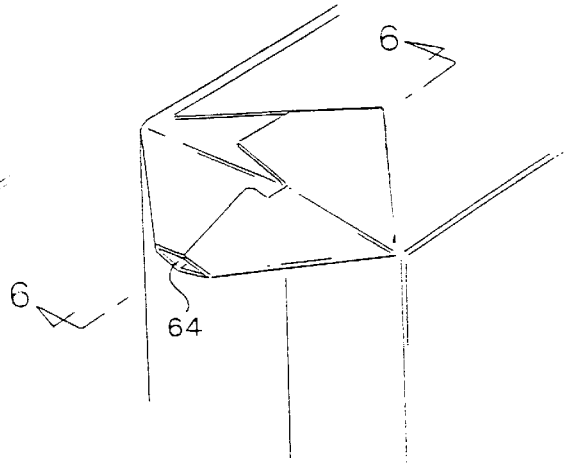
Fig 3

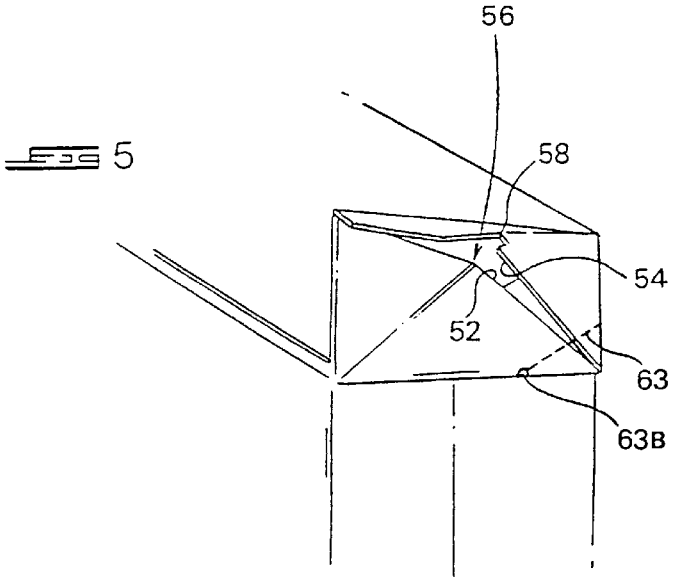
5
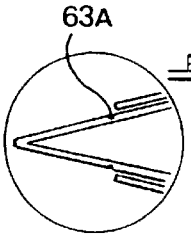
6B
6
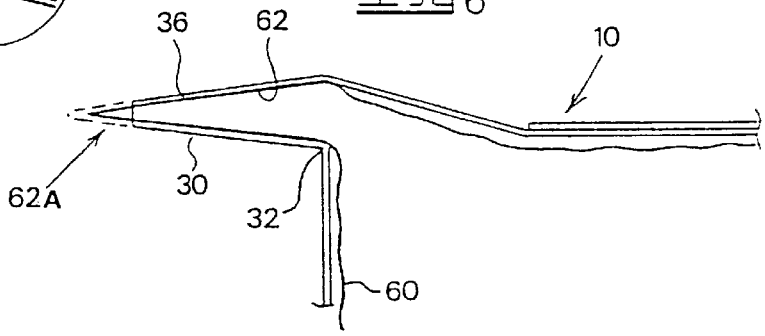
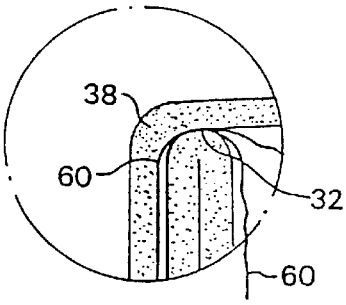
6C
6A
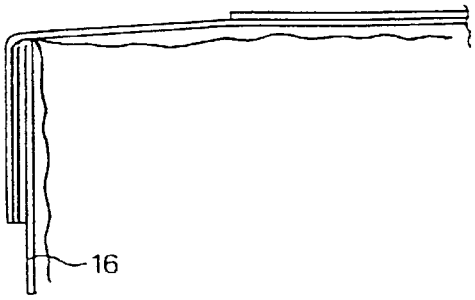

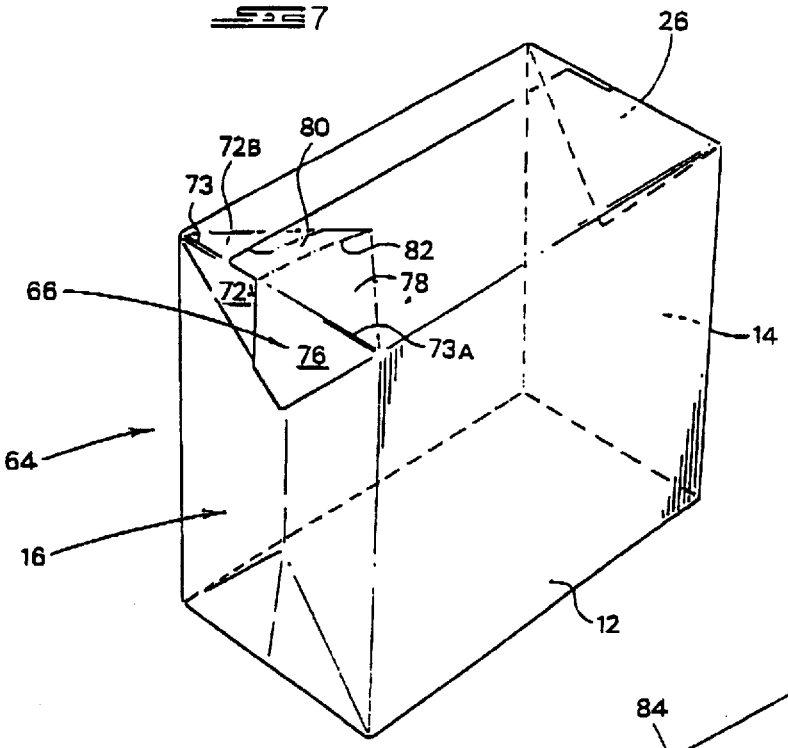
7
26
80
72B
73
82
78
66
72
76
73A
14
64
16
12
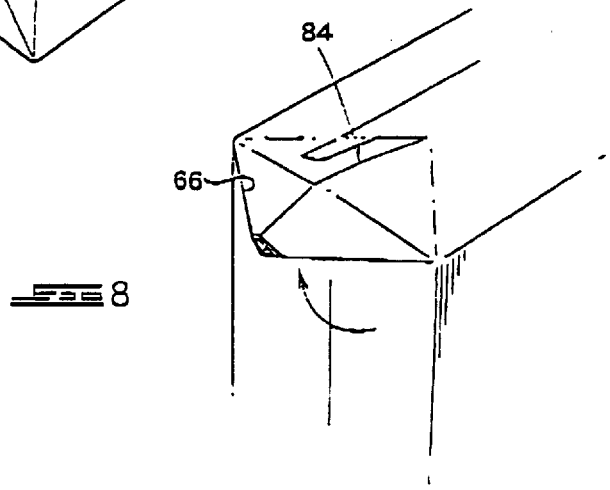
84
66
8

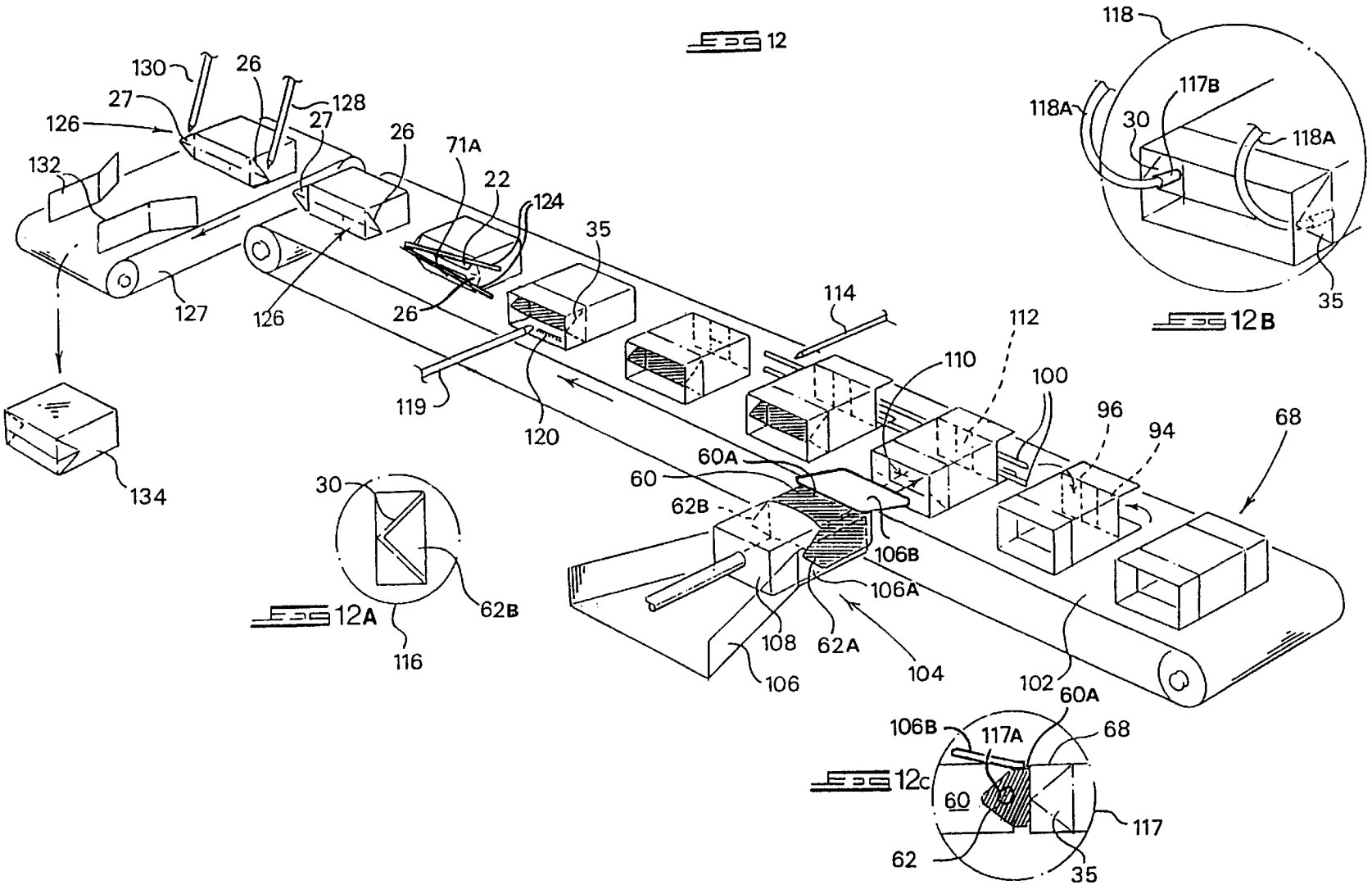
12
12A
12B
12C
118
118A
117B
30
35
68
94
96
100
112
110
114
102
60A
117
117A
106B
60
62
104
106A
62A
108
106
62B
120
119
124
22
71A
26
128
27
130
126
127
132
134
116

FLUID CONTAINERS AND METHODS OF MANUFACTURE THEREOF

BACKGROUND TO THE INVENTION

This application is a continuation-in-part of applicants' co-pending international patent application PCT/GB95/02690 filed on 16 Nov. 1995 and designating the USA.

French patent 2552403 discloses a fluid container for holding granular or powdery products. The fluid container is in the form of a bag-in-the-box container having a prismatic configuration. One of the ears of the bag locates within a corresponding projecting triangular ear extending from a top corner of the box. In order to dispense the granular contents of the container, the ear is lifted from a position in which it is folded down against a side wall of the box to a position in which the ear extends at right angles from the side wall. The entire ear, which remains in a flat unopened form, is then snipped off at its base at the top corner of the box so as to define an opening in the fluid container. An opening of this type has a number of disadvantages. First, the opening is relatively large, which means that the contents of the container can not be poured from the container in a controlled fashion. Second, the opening cannot be re-sealed or at least closed off once it has been opened, as a result of which the contents of the container are exposed to spillage. Insofar as a pouring spout exists, it is substantially flush with the top and side walls of the containers as a result of which, were liquid to be dispensed from the container, the residue would tend to drip down the side wall after pouring had taken place.

French patent 2680763 discloses a similar type of bag-in-the-box container having a pair of triangular ears extending from the top corners of the box. The bag has corresponding ears located within the triangular ears, and is designed to hold granular or powdery contents. A tip of the ear can be snipped off so that the remainder of the ear serves as a crude type of pouring spout The pouring spout remains essentially closed and flattened when the spout is folded upwardly into a raised pouring position, for the reason that the folding axis of the spout is essentially coincident with the top and bottom fold lines at the top corner of the box where the spout is joined to the box. In addition, the spout is in the form of a loose flap which is not selfsustaining when in the raised pouring position. These drawbacks prevent fluids, and in particular liquids, from being dispensed from the spout in a controlled and directed fashion.

U.S. Pat. No. 4,245,743 to Heuberg discloses a tear-open bag-in-the-box container in which an entire top portion of the box is torn away. A cross seam of the bag is glued to the tear-away portion of the box, and is provided with an appropriate tearing nick As a result, tearing away of the top portion of the box results in part of the cross seam of the bag being simultaneously torn away. The bag within the box then forms a pouring spout through which the liquid contents of the container can be dispensed.

As the bag is typically formed from a non-rigid material, the resultant spout will tend to be non-rigid, and may be prone to collapsing. A further drawback is that the spout opening is exposed and cannot be closed after use, as a result of which a container of this type is only suited to applications in which the entire liquid contents of the container are dispensed in a single pouring operation.

SUMMARY OF THE INVENTION

According to a first aspect of the invention there is provided a fluid container comprising a box folded from flexible sheet material, the box having side walls, a bottom closure and a top closure, and an integral pouring spout formation being formed between one of the side walls and the top closure, the spout formation comprising a lower projecting wall which folds along a lower fold line with respect to the side wall and an upper wall arrangement being pre-formed to define a spout passage in conjunction with the lower projecting wall when the pouring spout formation is in a raised pouring position and to collapse towards the lower projecting wall when the pouring spout is folded downwardly into a lowered position against the side wall, and a fluid-tight bag arranged to fit into the box, the bag having an inner spout located within the spout passage.

Preferably, the tip of the inner spout is arranged to nest within the tip of the pouring spout formation, so that both tips can simultaneously be removed in a single removal operation to obtain access to the fluid within the bag.

Conveniently, the upper wall arrangement has a rear portion which forms part of the top closure and a front projecting wing portion which is delineated from the rear portion by means of at least one upper fold line, and which overlies the lower projecting wall, the upper wall being pre-formed to bow upwardly above the plane of the top closure and the lower projecting wall so as to define the spout passage.

Typically, opposite walls defining the inner spout of the fluid tight bag are arranged to be sealed between the upper wall arrangement and the lower projecting wall along the upper and lower fold lines of the spout formation when the pouring spout is in the lowered position so as to prevent spillage of fluid from the bag once the bag has been opened.

Advantageously, the upper wall arrangement comprises first and second overlapping upper walls having first and second respective rear portions which form part of the top closure and first and second respective front projecting wing portions which are delineated from the rear portions by means of first and second respective upper fold lines.

In a preferred form of the invention, the inner spout may optionally be arranged to open and close in concert with the pouring spout formation by having its upper and lower walls fixed to the inner surfaces of the respective upper wall arrangement and lower wall of the pouring spout formation.

Typically, the first and second rear portions comprise first and second rear panels which are co-planar with the top closure when the pouring spout is in the lowered sealed position and which are angled upwardly out of the plane of the closure when the pouring spout is in the raised pouring position.

The first and second rear panels may be defined by first crease lines which extend diagonally and inwardly from opposite top corners of the box, and second crease lines forming the first and second upper fold lines and being arranged to overlie the lower fold line.

Tamper-indicating means may be provided on the spout formation, the tamper-indicating means comprising a tear-off tag defined within the first and/or second upper walls of the container.

Conveniently, the fluid container includes retaining means for retaining the pouring spout formation in the lowered position against the side wall.

Typically, the retaining means is constituted by the side wall being preformed to bow inwardly, such that when the pouring spout formation is folded downwardly against increasing resistance, the opposed adjacent side walls converge to relieve the resistance and create a force tending to bias the pouring spout formation against the side wall.

Alternatively or additionally, the retaining means includes an adhesive for temporarily adhering an inner surface of the pouring spout formation to the side wall The invention extends to a method of forming a fluid container comprising the steps of:

cutting a blank for a box from flexible sheet material;

forming the blank into a rectangular open-ended cylinder having opposed major side walls, opposed minor side walls, a plurality of bottom panels extending from an operatively lower edge of the side walls and defining a bottom opening, and a plurality of top panels extending from the upper edge of the side walls and defining a top opening, the top panels including a cover flap and an opposed under flap hinged to the major side walls and first and second opposed wing panels hinged to the minor side walls and to the cover flap and under flap;

providing a filled fluid-tight bag having a base end and a top end;

inserting the base end of the bag through the top opening by pressing a plunger against the top end of the bag, the bag being pre-formed to define at least one projecting ear extending from one side of the plunger, the ear being arranged to locate against an operatively inner face of the first wing panel on fill insertion of the bag into the open-ended cylinder; and folding down the cover flap over the under flap and folding down the first and second wing panels over the side panels, with the first wing panel forming a pouring spout formation and the car forming an inner spout nesting with the pouring spout formation.

In one form of the invention, the method includes the step of bonding an operatively lower surface of the projecting ear to the operatively inner face of the first wing panel.

The bonding step may include the step of applying adhesive to the operatively lower surface of the ear just prior to full insertion of the bag into the box.

In an alternative form of the invention, an adhesive noble is positioned against the inner face of the first wing panel just prior to insertion of the bag into the box, and adhesive is applied via the nozzle after insertion of the bag.

Conveniently, the method includes the steps, prior to insertion of the bag, of folding a pair of opposed side bottom flaps inwardly towards one another with an air vent being defined between the flaps for allowing air to escape on insertion of the bag, applying adhesive to the base end of the bag and the operatively upper surfaces of the side bottom flaps, and folding at least one additional bottom flap over the side bottom flaps so as to bond the base end of the bag to a thus formed bottom closure.

Preferably, the tag is separated from the front triangular panel by means of a perforated line, and the tag overlies the rear triangular panel.

According to a further aspect of the invention there is provided a fluid container comprising a box folded from flexible sheet material, the box having side walls, a bottom wall and a top wall, an integral pouring spout formation being formed between and extending from one of the side walls and the top wall, the pouring spout formation comprising a lower projecting wall which folds along a lower fold line with respect to the side wall, an upper projecting wall which folds along an upper fold line with respect to the top wall, and at least a top or side wall portion forming part of the top or side wall, the top or side wall portion being preformed to extend beyond the plane of the top or side walls to which it is joined and to define an open spout passage in conjunction with the lower and upper projecting walls when the pouring spout formation is lifted into a raised pouring position and to define an obturated spout passage when the pouring spout formation is folded downwardly into a lowered position against the side wall.

In a preferred form of the invention, a fluid-tight bag is arranged to fit into the box, the bag having an inner spout anchored within the spout passage, with a tip of the inner spout being arranged to nest within a tip of the pouring spout formation, so that both tips can simultaneously be removed in a single removal operation to obtain access to the fluid within the bag.

Conveniently, the upper and lower fold lines are movable between an open position when the pouring spout is lifted into the raised pouring position in which they define a substantially triangular or quadrangular opening within the open spout passage and a closed position when the pouring spout formation is folded into the lowered position against the side wall, in which they are parallel and substantially coincident with a corner edge between the top and side wall of the box.

Typically, the spout formation comprises the upper projecting wall, the lower projecting wall and the side wall portion, the side wall portion comprising first and second triangular panels delineated from the rest of the side wall of the container by first and second concave crease lines extending from a mid-point on the side wall towards opposite top corners of the box.

Advantageously, the first and second triangular panels are joined to one another along a central crease line which extends into the lower projecting wall of the spout formation so as to define corresponding first and second triangular spout panels.

The first and second triangular wall panels may be coplanar with the corresponding first and second triangular spout panels when the pouring spout formation is in the raised pouring position, with the central crease line being convex, and the remainder of the side wall bowing inwardly, such that the pouring spout formation defines a rigid self-supporting structure when in the raised pouring position.

Advantageously, the pouring spout formation is moved from the raised pouring position to a closed position by being inwardly collapsed about a point located at the intersection of the lower fold line and the central crease line, with the convex portion of the central crease line being inverted into a concave configuration when the spout formation is folded downwardly against the side wall.

In an alternative form of the invention, the fluid container includes both top and side wall portions which are preformed to bow outwardly and to extend beyond the plane of the respective top and side walls so as to define the open spout passage.

Typically, the tip of the pouring spout formation is delineated by a perforated cut line, and the tip of the bag is delineated by a line of weakness underlying the perforated cut line, whereby the tip of the box and the tip of the bag can be simultaneously torn off.

The invention extends to a blank of flexible sheet material which is cut and creased to form the fluid container. The flexible sheet material may be stiff paper, cardboard or corrugated sheeting such as E-flute corrugated board, or rigid plastic sheeting.

BRIEF DESCRIPTION OF THE DRAWINGS

FIG. 1 shows a perspective view of a first embodiment of a fluid container of the invention with a spout of the container in a lowered sealed position;

FIG. 2 shows a detail of the spout of FIG. 1 in an intermediate raised position;

FIG. 3 shows the spout of FIG. 2 in a raised position with its end snipped off;

FIG. 5 shows a detail of the pouring spout of FIG. 2 in a fully raised pouring position;

FIG. 6 shows a cross-section on the line 6-6 of FIG. 3, with the spout in the fully raised pouring position;

FIG. 6A shows a cross-sectional side view of the spout in the closed sealed position;

FIG. 6B shows an enlarged detail of the area encircled in FIG. 6;

FIG. 6C shows an enlarged detail of the area encircled in FIG. 6A;

FIG. 7 shows a perspective view of a second embodiment of a fluid container of the invention with the spout of the container in a lowered sealed position;

FIG. 8 shows a detail of a spout of FIG. 7 in a raised position;

FIG. 12 shows highly schematic pictorial views of various steps involved in the manufacture of the fluid container; and FIG. 12A to 12C show enlarged details of parts of the process shown in FIG. 12.

DESCRIPTION OF THE EMBODIMENTS

Figure 4:
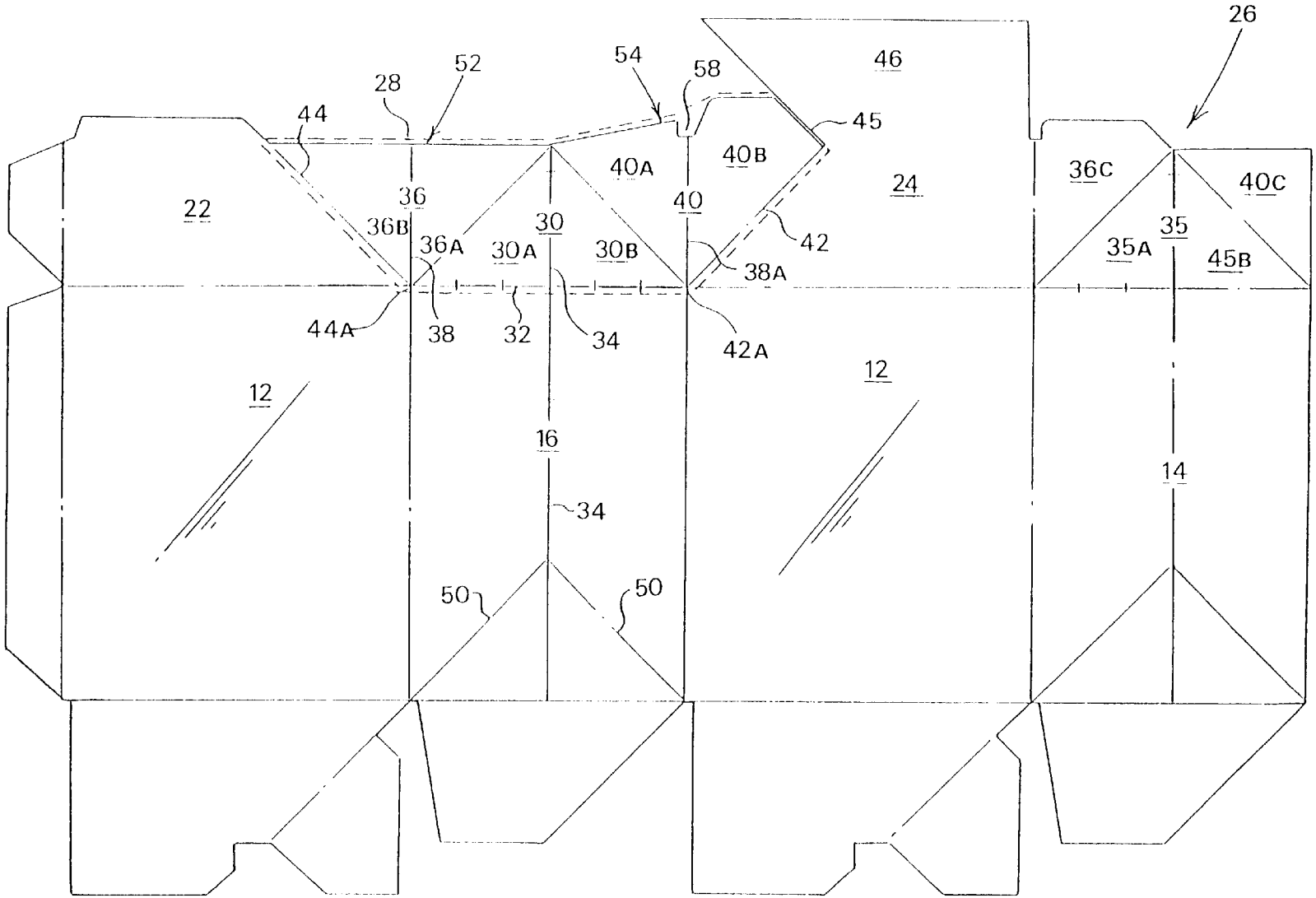
FIG. 4 shows a plan view of a blank from which the fluid container of FIG. 1 is formed.

Referring first to FIG. 1, a prismatic fluid container 10 is formed with opposed major side walls 12, opposed minor side or end walls 14 and 16, a base wall 18 and a top closure wall 20. As is clear from the blank 21 of the container illustrated in FIG. 4, the top closure wall 20 is formed principally from an under flap 22 hinged to one side wall 12 and a cover flap 24 hinged to the other side wall 12 and glued to the under flap 22. A first projecting triangular wing portion 26 is folded down against the end wall 14, and a second projecting triangular wing portion 27 forms part of a pouring spout formation 28, the various panel components of which are encircled in broken outline in the blank of FIG. 4. The blank is die cut from folding boxboard having a thickness of 250$\mu$m to 550$\mu$m.

The pouring spout formation 28 is formed from a number of triangular facets or panels defined by cut and fold lines, and includes a lower triangular wall 30 separated from the end wall 16 by a first fold line 32 and divided into first and second triangular panels 30A and 30B by means of a vertical fold line 34 which extends downwardly through the end wall 16. A similar vertical fold line 34A extends downwardly through the end wall 14. As can more clearly be seen in FIG. 4, the triangular wing portion 26 is similarly formed with a lower triangular wall 35. A first triangular upper wall 36 is divided into front and rear triangular panels 36A and 36B by means of a crease line 38, and a second upper wall 40 is divided into similar triangular front and rear panels 40A and 40B by a crease line 38A. The crease line 38A is substantially co-linear with the crease line 38 and is adjacent and parallel to the first fold line 32 when the spout formation 28 is in the folded down position indicated in FIG. 1.

Both of the rear panels 36B and 40B form part of the top closure wall 20. The rear panel 40B is separated from the cover flap 24 by means of an uppermost diagonal fold line 42 which extends inwardly from a top corner 42A of the box . Likewise, the rear panel 36B is separated from the under flap by means of a diagonal fold line 44, which extends inwardly from an opposed top corner 44A of the box. A diagonal cut line 45 defines an overlapping tongue portion 46 of the cover flap 24.

In a lowered sealed position indicated in FIG. 1, the triangular panels 36A and 40A of the first and second walls are collapsed against the respective triangular panels 30A arid 30B of the lower wall 30. Likewise, corresponding triangular panels 36C and 40C of the triangular wing portion 26 are collapsed against the respective triangular panels 35A and 35B of the lower triangular wall 35

As the spout formation 28 is raised from the closed position indicated in FIG. 1 through to an intermediate "centre" position indicated in FIG. 2, in which the lower wall 30 of the spout formation is angled just below (approximately 30°) the plane of the top closure 20, the first and second upper walls 36 and 40 begin bow outwardly along the fold or crease lines 38 and 38A, with the triangular panels 40B and 36B being angled upwardly relative to the cover flap 24. The first and second walls 36 and 40 have a memory when in the bowed state. This has the effect of biasing the spout formation into the fully raised position indicated in FIG. 5 once the spout formation is raised into a "over-centre" position beyond the "centre" position indicated in FIG. 2. In the fully raised position indicated in FIG. 5, in which the lower wall 30 is elevated at approximately 30° relative to the plane of the top closure 20, the edges 52 and 54 of the respective first and second upper walls 36 and 40 expand outwardly so as to define a spout opening 56 between the walls. The pouring spout is held in the raised pouring position by virtue of the static tension between the fold lines 42 and 44, 38 and 38A and 32.

When the pouring spout formation 28 is folded downwardly from the raised pouring position beyond the "centre" position of FIG. 2, it is biased towards the closed position of FIG. 1 as the resistance diminishes. Both of the end walls of the container are pre-formed with fold lines 34 so as to develop slight concavity when the first and second wings 26 and 27 are folded downwardly. The fold line or crease 34 meets two divergent creases 50 which extend to the bottom corners of the blank The slight concavity receives the downwardly folded wing portions so that they lie in planes defined by the perimeters of the end walls 14 and 16, and substantially flush with the ends of the container. The precise mechanism by which the first and second wings 26 and 27 are biased into the lowered sealed position of FIG. 1 is described in more detail in the complete specification of South African patent 93/5278, the contents of which are incorporated herein by reference. Basically, as the end walls 14 and 16 bow inwardly, the side walls 12 converge and create a force tending to bias the wings downwardly into engagement with the end walls so as to hold them against the end walls when the flaps 22 and 24 are in the closed condition. The crease formations 34 and 50 assist in the inward bowing of the end walls 14 and 16.

The edge 54 is formed with a notch 58 adjacent the fold or crease line 38A so as to reduce overlapping of the first and second upper walls 36 and 40 along the corner crease lines 38 and 38A, which would undesirably tend to urge the pouring spout upwardly when held in the closed condition.

As is clear from FIGS. 3 and 6, the box 10 contains a sealed fluid-tight bag 60 formed from a suitable plastics material such as polyethylene or polypropylene for containing a suitable liquid or granular fluid A typical construction comprises an outside barrier layer of 12$\mu$ PVDC coated polyester laminated to an inner 40$\mu$ to 50$\mu$ LDPE layer. In one version of the invention, a perforated cut line 63 extends across the tip of the pouring spout formation at a position where the pouring spout formation would normally be cut. As is clear from the cross-sectional detail in FIG. 6, a corresponding laser cut recess 63A extends at least through an outer part of the plastics material, which may be an outer layer of a laminate. The laser cut recess may be formed using the technology of the type developed by C.L.P.- GAL Industries Limited, of Kibbutz Negba, M.P. Sde Gat, Israel, which allows a fluid bag to be partly cut without rupturing it, so that it is sufficiently strong to bold its liquid contents whilst at the same time providing a line of weakness along which the tip of the inner spout 62 can be torn. The provision of the perforated cut line 63 and the underlying laser cut line 63A allows the tip of the pouring spout formation 28 and the inner spout 62 to be torn off without the use of scissors or an alternative snipping tool. In order to assist in tearing, a half moon-shaped recess 63B may be formed at one edge of the perforated cut line 63. Should it be impractical, in view of the nature of the material, to define a line of weakness along the inner spout of the bag material, then solely the spout formation 28 could be provided with the perforated cut lines or printed cut lines as a snipping or tearing guide.

The upper surface of the spout 62 is glued to the inner surfaces of the walls 36 and 40, and the lower surface of the spout is glued to the upper surface of the lower wall 30. As a result, when the pouring spout formation 28 is moved into its raised pouring position indicated in FIGS. 5 and 6, this has the effect of opening up the inner spout 62. Alternatively, only the lower surface of the spout is glued to the upper surface of the lower wall, with the inner spout 62 being automatically opened up by the ingress of fluid into the inner spout cavity during pouring. As is shown at 62A in FIG. 3 and in broken outline in FIG. 6, the ends of the outer and inner spouts 28 and 62 are then torn or snipped off so as to facilitate pouring of the liquid from the bag 60. The "memory" of the bowed first and second upper walls tends to hold the spout in a rigid raised pouring position, and prevents it from collapsing inwardly during pouring.

In a preferred version, the bag is micro-welded without any gussets in a process known as "impulse welding". This process takes place on form-fill-seal machines of the type manufactured by Autopac Machinery Corporation, of P 0 Box 73, Ferndale, 2160, South Africa, and allows the bag edge to be welded closed through the contents of the bag such as a powdered or liquid detergent, whilst still providing a relatively strong and fluid-tight seal at relatively high welding speeds.

Once the desired quantity of liquid has been poured from the bag, the pouring spout is then folded down into its closed sealed position indicated in FIG. 6A. It is clear from the detailed in FIG. 6A how a sealing effect is achieved by the first and second upper walls 36 and 40 collapsing against the lower wall 30 and the corner defined by the crease lines 38 and 38A being braced against the corner defined by the fold line 32. Liquids and granular fluids can thus readily be stored in the bag 60 once it has been opened, without danger of being spilt.

Turning now to FIG. 7, a tamper-indicating fluid container 64 is shown, those parts of the container which are similar to the container of FIGS. 1 and 6A are indicated with identical numerals. The container 64 has a pouring spout formation 66, the various panel components of which are encircled in chain outline 70 in the blank of FIG. 9. The top closure 71 is formed with an under flap 22 and an upper flap 71A. A first triangular upper wall 72, which is similar to the upper wall 36 of FIG. 4, is divided into front and rear triangular panels 72A and 72B by means of an upper fold line 73. A second upper wall 74 is divided into a triangular front panel 76 and a triangular rear panel 78 by means of an upper fold line 73A. A tear-off tag 80 is separated from the front triangular panel 76 by means of a perforated line 82. As can more clearly be seen in FIG. 7, the tear-off tag 80 overlies the rear triangular panel 72B, and located against the upper surface of the rear triangular panel 72B in the closed position illustrated in FIG. 7 with the pouring spout formation 66 being folded down.

In order to open the container, the tamper-indicating tag 80 is tom free, as is shown at 84 in FIG. 8, which allows the pouring spout 66 to be folded upwardly into the raised position illustrated in FIG. 8. When the pouring spout is closed in the position indicated in FIG. 7, the upper fold lines 73 and 73A directly overlie the lower fold line 32. This position is essentially identical to that of the first embodiment illustrated in detail in FIG. 6A, in which the upper fold line 38 directly overlies the lower fold line 32 so as to seal opposite walls of the plastic spout 62. Raising of the spout 66 causes upward movement of the fold lines 73 and 73A away from the fold lines 32, with the rear triangular panels 72B and 78 moving upwardly out of the plane defined by the upper flap 71A and the under flap 22.

Figures 9, 10A, 10B, 10C:
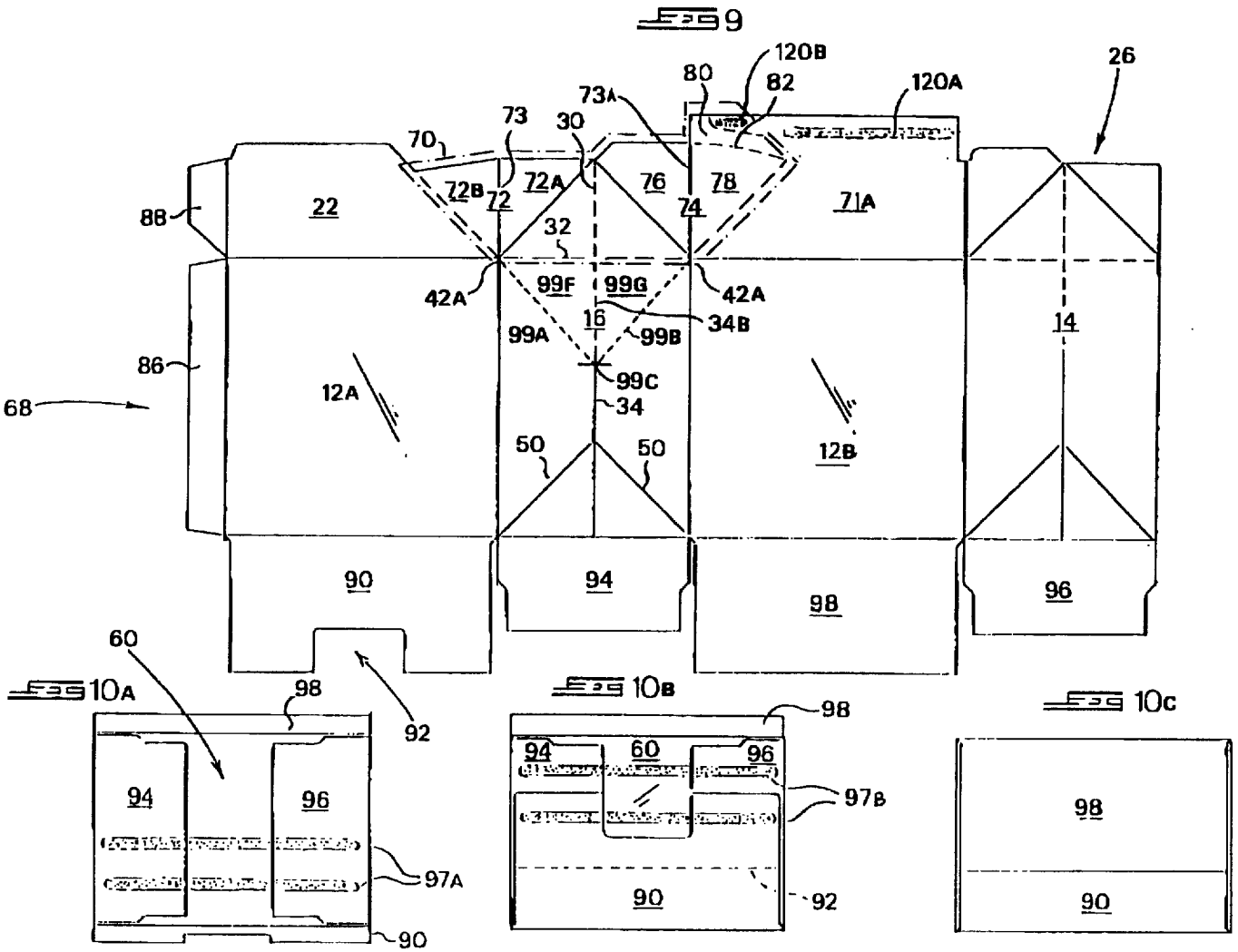
FIG. 9 shows a plan view of a blank from which the fluid container of FIG. 7 is formed.
FIGS. 10A to 10C show underplan views of various steps in the manufacture of the fluid container of FIG. 7.

The blank 68 of FIG. 9 is formed with major side walls 12A and 12B and minor end walls 14 and 16. Glue flaps 86 and 88 extend from the free side edges of the respective major side wall 12A and the underflap 22. During the assembly process, adhesive is applied to the operatively upper surfaces of the flaps 86 and 88, which are in turn glued to the undersurface of the free edge of the minor end wall 14 and the triangular wing portion 26 so as to create an open-ended rectangular cylinder.

Extending from a lowermost edge of the major side wall 12A is an inner base flap 90. A centrally located rectangular cut-out 92 extends from a lowermost edge of the base flap 90. Side flaps 94 and 96 similarly extend from the lowermost edges of the respective minor end walls 16 and 14, and an outer base flap 98 extends from the lowermost edge of the side wall 12B. The side flaps 94 and 96 are shorter than the inner and outer base flaps 90 and 98 by a distance which corresponds to the depth of the cut-out 92.

Just prior to insertion of the bag 60 through the open top end of the partly formed container, the side flaps 94 and 96 are folded down. A first series of glue lines 97A is then applied over the exposed surfaces of the flaps and the base of the bag. The intermediate base flap 90 is then folded down over the glue lines 97A, as is clear from FIG. 10B, after which a second series of glue lines 97B are applied over the exposed lowermost surfaces of the side flaps 94 and 96 and the base of the bag 60, as well as over that portion of the intermediate base flap 90 above the broken line 92 which is to be covered by the outer base flap 98. The outer base flap 98 is then folded down into position, as is indicated in FIG. 10C.

By providing the cut-out 92 and the recessed side flaps 94 and 96, adhesive can be applied simultaneously to the outer surfaces of the various flaps and the base of the bag, thereby allowing the flaps 90, 94 and 96 as well as the bag 60 to be glued to the outer flap 98. As the base of the bag 60 is firmly glued to the base of the container, the bag is in this preferred version of the invention anchored firmly within the container at both its base and spout ends, which prevents it from working loose and facilitates the pouring operation.

In an alternative version of the invention, the side wall 16 is pre-formed to bow outwardly beyond the plane of the side wall so as to assist in defining the spout passage. What is effectively happening is that the box is being turned about 90°, with the side wall of the box becoming the top wall and vice versa. This is achieved by providing crease lines 99A and 99B which terminate at a horizontal nick line 99C along the central crease line 34. The crease lines 99A and 99B are arranged to bow outwardly so as to define the pouring spout formation. In this version, the upper wall arrangement may be eliminated completely, with the spout formation folding upwardly along its upper fold line 32 and the entire upper wall of the box remaining within the plane of the upper wall when the spout formation is raised.

Figure 11:
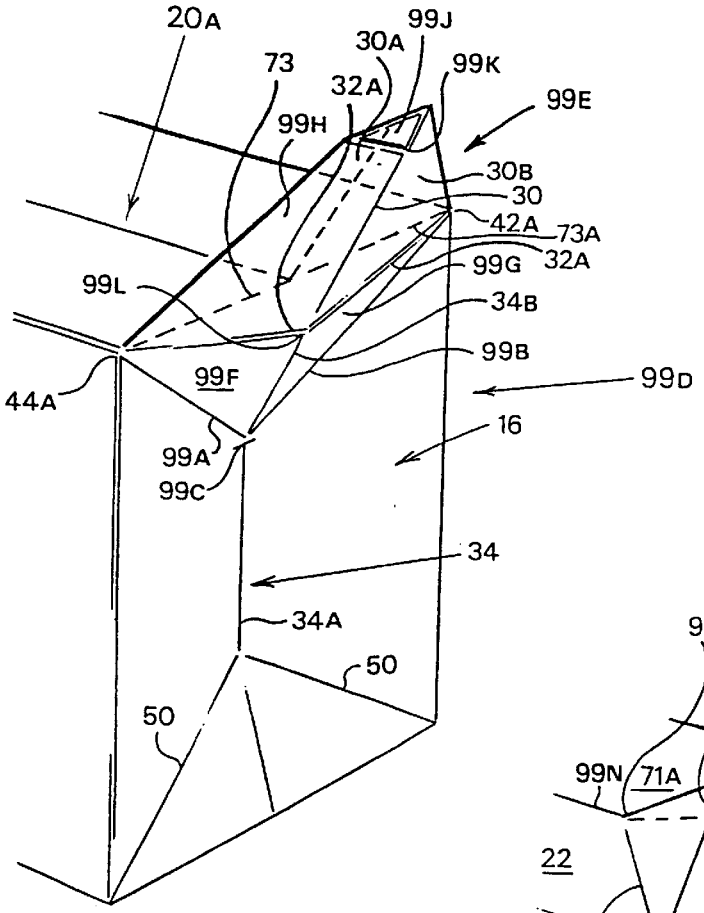
FIG. 11 shows a perspective view of a third embodiment of a fluid container of the invention with the pouring spout in a raised pouring position.

An erected container 99D with a spout formation 99E is illustrated in FIG. 11. The front wall 16 of the container is formed with the concave creases 99A and 99B extending from the nick 99C to the opposite top corners 44A and 42A of the box so as to define side wall portions in the form of triangular panels 99F and 99G. It can clearly be seen how the central crease line 34 has a first intermediate portion 34A which folds inwardly or concavely below the nick 99C and a second upper portion 34B which assumes a convex form which is co-linear with the convex crease line 30. The lower diagonal crease lines 50 also assume an inwardly bowed concave form. In the deployed position, the triangular panels 30A and 30B are coplanar with the corresponding triangular panels 99F and 99G.

These panels, in combination with a triangular face 99H constituting the upper wall of the spout formation and formed from panels corresponding to the two upper triangular panels 72A and 76, illustrated in FIG. 9, define the self-sustain spout formation 99E. The upper wall 99H of the spout formation is separated from the top wall 20A of the box along a fold line corresponding to fold lines 73 and 73A. When the tip of the spout formation is snipped or torn off, a triangular aperture 99J results, having a lower apex 99K, which increases pouring precision when dispensing the fluid contents from the bag (not shown) within the container. After pouring has been completed, gentle inward pressure is applied to point 99L at the intersection of the convex crease lines 30 and 34B and the fold line 32A This results in the fold line 32A moving towards the upper fold lines 73 and 73A so that the triangular opening at the base of the spout formation 99E defined by these fold lines closes. This allows the projecting portion of the spout formation to be folded downwardly about the now parallel and adjacent fold lines 73, 73A and 32A, which are substantially coincident with a corner edge of the box. As downward folding of the spout formation occurs, the crease line 34B inverts from being convex to being flat or slightly concave, with the spout formation being biased against the side wall. Folding down of the spout formation is assisted by the application of gentle inward pressure at opposite top corners 99D of the box.

Figure 11A:
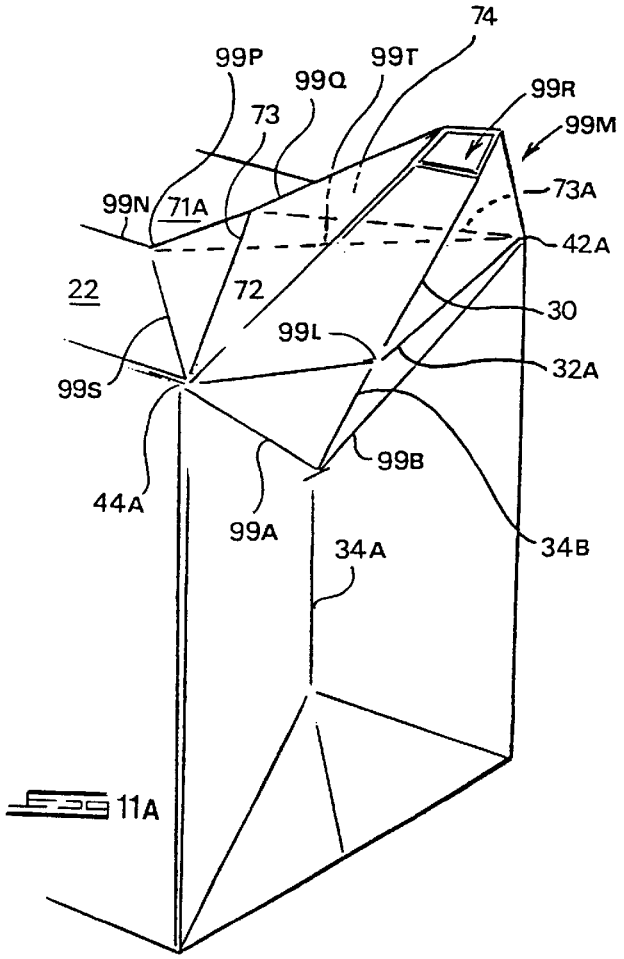
FIG. 11A shows a perspective view of a fourth embodiment of a fluid container of the invention with the spout in a raised pouring position.

Referring now to FIG. 11A, a further alternative pouring spout formation 99M is shown. This spout formation is similar to the spout formation illustrated in FIG. 11, save that the structure provided by the lower wall of the spout formation is substantially duplicated in the upper wall of the spout formation. This is achieved by utilising all of the crease lines illustrated in the blank of FIG. 9, with the triangular panels 72 and 74 constituting the upper wall of the spout formation. The flaps 22 and 71A of the upper wall are arranged to bow inwardly along a central overlapping line 99N rearwardly of the point 99P and to bow outwardly forwardly of the point 99P, along convex overlapping or crease line 99Q. In this embodiment, the spout opening 99R is substantially diamond shaped, as is the opening defined at the base of the spout between the lower fold line 32A and the upper fold lines 73 and 73A.

In a still further alternative embodiment, both the central crease line 99N between the overlapping top flaps 22 and 71A and the extension of this crease line 99Q is arranged to bow outwardly when the opposite top corners 44A and 42A of the box are pushed towards one another, thereby avoiding the need for crease lines 99S and 99T.

The spout formations of FIGS. 11A and 11B are folded down in the same manner as was described with reference to FIG. 11, with the combined inward bowing of the crease lines 34A and 34B contributing to retaining the spout formations in the lowered closed position in the manner previously described.

Referring now to FIG. 12, a highly schematic view of various steps involved in the manufacture of the fluid container is shown. The entire manufacturing process typically takes place on a machine which is similar to the fully automatic horizontal RSB6 cartoner series of the type manufactured by Jacob White (Packaging) Limited of Riverside Industrial Estate, Riverside Way, Dartford, Kent, United Kingdom.

The blank 68 is shown in its erected form as per FIG. 10A, at the stage when it resembles an open-ended rectangular cylinder As was described previously, the side flaps 94 and 96 are folded inwardly, and are held in position by one or more retaining bars 100. During the various folding and gluing operations, the boxes are moved along a suitable conveyer, which is represented schematically in FIG. 11 by a first conveyer belt 102.

Once the flaps 94 and 96 are secured, the container 68 is moved to filling stations 104, where filled bags 60 slide down a transverse hopper or feed shoot 106. A drive piston 108 having a rectangular profile is used to urge the bag 60 into the open top end 110 of the partly formed container 68. The piston 108 is dimensioned to have a width which is just smaller than the width of the top surface presented by the bag 60, with the result that as the piston presses against the operatively upper surface of the bag, a pair of triangular ears defining inner spouts 62A and 62B arc formed on opposite sides of the piston 108 between the side wails of the piston and the constricted side walls 106A of the feed hopper. The chute 106 may also be formed with a top wall 106B for assisting in manoeuvring the convex upper top wall 60A of the bag 60 into the open top end 110 of the box. As the bag 60 is inserted through the opening 110, air escapes through an air vent 112 defined between the flaps 94 and 96, with the reaction bars 100 serving to hold the partly formed container and the flaps 94 and 96 in position. The various gluing and folding steps described with reference to FIG. 10A to 10C are then performed, with at least one adhesive nozzle 114 being used to apply glue lines to the various base flaps of the container in the manner previously described.

It can clearly be seen in the detail at 116 how the triangular ears 62A and 62B of the bag 60 cover the inner surfaces of the triangular walls 30 and 35 of the container. Adhesive may optionally be applied to the inner surface of the lower triangular wall 30 as well as to the inner surface of the upper triangular wall 36 for facilitating adhesion of the upper and lower surfaces of the triangular ear 62B to the respective upper and lower triangular walls 36 and 30.

The adhesive may be applied in a number of different ways. In a first method of application which is illustrated in detail at 117, adhesive is applied in a small blob 117A towards the base of the outer surface of each ear 62A and 62B when the bag 60 is almost fully inserted into the box 68, with the result that as the bag is fully inserted, the adhesive blob 117A smears in a line down the inner surface of the triangular wall 35, with the side walls of the piston serving to press the triangular car 62A against the triangular wall 35. The identical gluing operation occurs in gluing the outer surface of the triangular ear 62B to the inner surface of the triangular wall 30.

In an alternative second preferred gluing method illustrated in detail at 118, a pair of curved gluing nozzles 118A having a relatively flat profile are located against the inner surfaces of the triangular walls 30 and 35, with the ends of the nozzles being located at the approximate centres of the triangles. The bag 60 is then inserted into the opening 110 in the box, and once the FIG. 10B position has been reached, the glue nozzles 118A are activated, and spray a line of glue 117B between the bases and apices of the triangular walls 30 and 35 and the respective triangular ears 62B and 62A, after which the curved nozzles 118A are retracted.

An adhesive nozzle 119 is then used to apply first and second glue lines 120A and 120B, in the manner indicated in FIG. 9, to the inner surface of the upper flap 71 A The first glue line 120A terminates short of the chain outline 70, which encloses the various panel components making up the pouring spout formation 66. The second glue line 120A is positioned on the other side of the fold line defining the rear triangular panel 78 between the tear-off tag 80 and the upper free edge of the triangular rear panel. The triangular rear panel 78 thus has a fixed portion which is glued to the underflap and a free portion which is separated from the fixed portion by means of the tamper-indicating tag. Once the tag 80 is tom free, the pouring spout can be folded upwardly into the raised position. The first and second glue lines 120A and 120B may be incorporated as a single continuous line. At a stage where the adhesive nozzle 119 of the glue gun is applying glue in the manner illustrated in the detail of FIG. 11, the side creases 34 are pressed gently inwards so as to ensure that the creases 34 and 34A do not bow outwardly and to assist in folding the wings 26 and 27 into the closed position.

Suitable folding arms or bars 124 are used to fold the under flap 22 and the cover flap 71A towards one another, with the cover flap being folded over the underflap. This has the simultaneous effect of causing the triangular wing portions 26 and 27 and the triangular ears 62A and 62B which are bonded to the respective triangular walls 30 and 35 to fold outwards to a position indicated at 126 in which they are co-planar with the glued together under flap 22 and cover flap 71A.

The container is then moved through 90° so as to travel along a second conveyer 127. Adhesive is optionally applied to the rear surfaces of the triangular wings 26 and 27 by respective glue nozzles 128 and 130, with the stronger adhesive being applied behind the triangular wing 26 so as to affix it permanently to the underlying end wall 14. The triangular wing 27, which forms part of the pouring spout formation 28, may be glued down by a relatively weak adhesive such as a wax or resealable compound in order to hold it temporarily in position. Alternatively, no glue whatsoever is applied to the wing portion, which is biased into the closed sealed position in the manner described earlier on in the specification, as well as in the complete specification of South African patent 93/5278, by virtue of the structure of the pack. The wings 26 and 27 are folded down against the respective end walls 14 and 16, by being passed through a pair of spaced folding guides 132, so as to arrive at the complete bag-in-the-box container 134.

The liquid container of the invention has a number of advantages over existing containers. The container is suited to a high speed automated manufacturing process of the type previously described, as well as to a manual assembly process for smaller production runs. As the cardboard box and the plastic bag are separable, they can easily be re-cycled. The plastic bag and the cardboard box can also be manufactured from re-cycled materials, making the entire construction environmentally friendly.

The type of plastic from which the bag is made can easily be altered so as to accommodate all types of fluids, including corrosive fluids such as alkalines and acids, as well as liquids such as wines in which a UV protective additive may be required. The particular bowed structure of the side walls lends to the container having a relatively high vertical crushing resistance, which allows it to be stacked and transported relatively easily. The re-sealing feature provided by the folded down pouring spout reduces spillage, and makes the liquid within the container less prone to picking up external odours once the container has been initially opened. In cases where the liquid contents of the bag require sterilisation, this can be done as a separate step, before the bag is fitted into the box. The structure of the pouring spout and the inner nested spout and the manner in which the tips can be torn or snipped off reduces spillage and facilitates the pouring of liquids from the container.

We claim:

1. A fluid container comprising a box folded from flexible sheet material, the box having side walls, a bottom closure and a top closure, and an integral pouring spout formation being formed between and extending from one of the side walls and the top closure, the spout formation comprising a lower projecting wall which folds along a lower fold line with respect to the one side wall and an upper wall arrangement, the lower projecting wall and the upper wall arrangement being pre-formed to define an open spout passage in conjunction with the lower projecting wall when the pouring spout formation is in a raised pouring position and to collapse towards the lower projecting wall when the pouring spout is folded downwardly into a lowered position against the one side wall, and a fluid-tight bag arranged to fit into the box, the bag having an inner spout located within the spout passage, wherein the upper wall arrangement comprises first and second overlapping upper walls having first and second respective rear portions which form part of the top closure and first and second respective front projecting wing portions which are delineated from the rear portions by means of first and second respective upper fold line portions constituting the upper fold line.

2. A fluid container according to claim 1, wherein the first and second rear portions comprise first and second rear panels which are coplanar with the top closure when the pouring spout is in the lowered sealed position and which are angled upwardly out of a plane of the closure when the pouring spout is in the raised pouring position.

3. A fluid container according to claim 2 wherein the first and second rear panels are defined by first crease lines which extend diagonally and inwardly from opposite top corners of the box, and second crease lines forming the first and second upper fold lines and being arranged to overlie the lower fold line.

4. A fluid container comprising a box folded from flexible sheet material, the box having side walls, a bottom closure and a top closure, and an integral pouring spout formation being formed between and extending from one of the side walls and the top closure, the spout formation comprising a lower projecting wall which folds along a lower fold line with respect to the one side wall and an upper wall arrangement, the lower projecting wall and the upper wall arrangement being preformed to define an open spout passage in conjunction with the lower projecting wall when the pouring spout formation is in a raised pouring position and to collapse towards the lower projecting wall when the pouring spout is folded downwardly into a lowered position against the one side wall, and a fluid-tight bag arranged to fit into the box, the bag having an inner spout located within the spout passage, the fluid container further including retaining means for retaining the pouring spout formation in the lowered position against the side wall, wherein the retaining means is constituted by the one side wall being preformed to bow inwardly, such that when the pouring spout formation is folded downwardly against increasing resistance, with opposed side walls converging adjacent the one side wall to relieve the resistance and create a force tending to bias the pouring spout formation against the one side wall.

5. A fluid container comprising a box folded from flexible sheet material, the box having side walls, a bottom closure and a top closure, and an integral pouring spout formation being formed between and extending from one of the side walls and the top closure, the spout formation comprising a lower projecting wall which folds along a lower fold line with respect to the one side wall and an upper wall arrangement, the lower projecting wall and the upper wall arrangement being preformed to define an open spout passage in conjunction with the lower projecting wall when the pouring spout formation is in a raised pouring position and to collapse towards the lower projecting wall when the pouring spout is folded downwardly into a lowered position against the one side wall, and a fluid-tight bag arranged to fit into the box, the bag having an inner spout located within the spout passage, the fluid container further including retaining means for retaining the pouring spout formation in the lowered position against the side wall, wherein the retaining means includes an adhesive for temporarily adhering an inner surface of the pouring spout formation to the one side wall.

6. A fluid container comprising a box folded from flexible sheet material, the box having side walls, a bottom wall and a top wall, an integral pouring spout formation being formed between and extending from one of the side walls and the top wall, the pouring spout formation comprising a lower projecting wall which folds along a lower fold line with respect to the one side wall, an upper projecting wall which folds along an upper fold line with respect to the top wall, and at least a top or side wall portion of the one side wall forming part of the top or the one side wall, the top or the one side wall portion being pre-formed to extend beyond a plane of the top or the one side wall to which it is joined and to define an open spout passage in conjunction with the lower and upper projecting walls when the pouring spout formation is lifted into a raised poring position and to define an obturated spout passage when the pouring spout formation is folded downwardly into a lowered position against the one side wall, wherein a fluid-tight bag is arranged to fit into the box, the bag having an inner spout located within the spout passage, with a tip of the inner spout being arranged to nest within a tip of the pouring spout formation, so that both tips can simultaneously be removed in a single removal operation to obtain access to the fluid within the bag.

7. A fluid container according to claim 6, wherein the upper and lower fold lines are movable between an open position when the pouring spout is lifted into the raised pouring position in which they define a substantially triangular or quadrangular opening within the open spout passage and a closed position when the pouring spout formation is folded into the lowered position against the one side wall, in which they are parallel and substantially coincident with a corner edge between the top and the one side wall of the box.

8. A fluid container according to claim 6, wherein the spout formation comprises the upper projecting wall, the lower projecting wall and the one side wall portion, the one side wall portion comprising first and second triangular panels delineated from the rest of the one side wall of the container by first and second concave crease lines extending from a mid-point on the one side wall towards opposite top corners of the box.

9. A fluid container according to claim 8, wherein the first and second triangular panels are joined to one another along a central crease line which extends into the lower projecting wall of the spout formation so as to define corresponding first and second triangular spout panels.

10. A fluid container according to claim 9, wherein the first and second triangular wall panels are coplanar with the corresponding first and second triangular spout panels when the pouring spout formation is in the raised pouring position, with the central crease line being convex, and the remainder of the one side wall bowing inwardly, such that the pouring spout formation defines a rigid self-supporting structure when in the raised pouring position.

11. A fluid container according to claim 10, wherein the pouring spout formation is moved from the raised pouring position to a closed position by being inwardly collapsed about a point located at the intersection of the lower fold line and the central crease line, with the convex portion of the central crease line being inverted into a concave configuration when the spout formation is folded downwardly against the one side wall.

12. A fluid container according to claim 6 which includes both top and side wall portions which are pre-formed to bow outwardly and to extend beyond the plane of the respective top and one side wall so as to define the open spout passage.

13. A fluid container according to claim 6 wherein the tip of the pouring spout formation is delineated by a perforated cut line, and the tip of the bag is delineated by a line of weakness underlying the perforated cut line, whereby the tip of the box and the tip of the bag can be simultaneously torn off.

* * * * *